US007736289B2

(12) United States Patent
Pettersson

(10) Patent No.: US 7,736,289 B2
(45) Date of Patent: Jun. 15, 2010

(54) CUTTING-AND CREASING-WHEEL ASSEMBLY, AND A METHOD FOR CUTTING AND CREASING A COMPRESSIBLE MATERIAL

(76) Inventor: Niklas Pettersson, 2035 Candle Tree Cove, Sandy, UT (US) 84092

( * ) Notice: Subject to any disclaimer, the term of this patent is extended or adjusted under 35 U.S.C. 154(b) by 0 days.

(21) Appl. No.: 11/817,038

(22) PCT Filed: Feb. 22, 2006

(86) PCT No.: PCT/SE2006/000233

§ 371 (c)(1),
(2), (4) Date: Nov. 9, 2007

(87) PCT Pub. No.: WO2006/091149

PCT Pub. Date: Aug. 31, 2006

(65) Prior Publication Data

US 2008/0148917 A1 Jun. 26, 2008

(30) Foreign Application Priority Data

Feb. 25, 2005 (SE) ..... 0500431

(51) Int. Cl.
*B31F 1/10* (2006.01)

(52) U.S. Cl. ..... 493/368; 493/366; 493/367; 493/370; 493/371; 83/879; 83/881

(58) Field of Classification Search ..... 493/340, 493/352, 354–355, 366–368, 370–371; 83/881, 83/879, 886–887
See application file for complete search history.

(56) References Cited

U.S. PATENT DOCUMENTS 3,882,765 A * 5/1975 Tokuno ..... 493/362
4,095,511 A * 6/1978 Woolston ..... 493/34
4,224,847 A * 9/1980 Tokuno ..... 83/74

(Continued)

FOREIGN PATENT DOCUMENTS

GB 2275885 9/1994

(Continued)

OTHER PUBLICATIONS

Chinese Patent Office Action, dated May 22, 2009 and issued in corresponding Chinese Patent Application No. 200680013656.0.

*Primary Examiner*—Christopher Harmon
(74) *Attorney, Agent, or Firm*—Young & Thompson

(57) ABSTRACT

A cutting- and creasing -wheel assembly includes a cutting tool, such as a circular disc having a continuous or a serrated cutting edge. The disc is rotatable and supported between a pair of rotatable creasing- wheel halves, the creasing-wheel halves being of equal radial dimension. The disc is controllable for movement between a non-operative position wherein the cutting edge is withdrawn radially inside the outer peripheries of the creasing-wheel halves, and an operative position wherein the cutting edge is projecting radially outside the peripheries. The method of slitting a corrugated or otherwise compressible material involves the provision and control of a cutting tool, preferably a circular disc having a continuous or serrated cutting edge. The disc is arranged to be rotatable and movably supported between a pair of rotatable creasing-wheel halves of equal radial dimension in a cutting- and creasing wheel assembly.

14 Claims, 2 Drawing Sheets

U.S. PATENT DOCUMENTS

| | | | | | |
|---|---|---|---|---|---|
| 4,596,541 | A | * | 6/1986 | Ward et al. | 493/59 |
| 4,805,502 | A | | 2/1989 | Ishigure | |
| 4,932,298 | A | * | 6/1990 | Capdebosco | 83/332 |
| 5,125,258 | A | | 6/1992 | Warner | |
| 5,466,211 | A | * | 11/1995 | Komarek et al. | 493/355 |
| 5,533,956 | A | * | 7/1996 | Komarek et al. | 493/355 |
| 5,540,128 | A | * | 7/1996 | Creaden | 83/305 |
| 5,596,918 | A | * | 1/1997 | Longwell et al. | 83/332 |
| 6,007,470 | A | * | 12/1999 | Komarek et al. | 493/397 |
| 6,071,222 | A | * | 6/2000 | Schneider | 493/355 |
| 6,478,725 | B1 | | 11/2002 | Bengt et al. | |

FOREIGN PATENT DOCUMENTS

| | | |
|---|---|---|
| WO | WO 9705992 | 2/1997 |
| WO | WO 2004/056685 | 7/2004 |

* cited by examiner

CUTTING-AND CREASING-WHEEL ASSEMBLY, AND A METHOD FOR CUTTING AND CREASING A COMPRESSIBLE MATERIAL

TECHNICAL FIELD

The present invention refers to a cutting- and creasing-wheel assembly useful for producing slits and creasing-lines in a material. The invention also refers to a method for cutting and creasing a material, such as webs or boards of corrugated or otherwise compressible paper or plastics.

BACKGROUND AND PRIOR ART

In the production of packaging blanks, e.g., it is a common practice to feed a web material to be engaged by creasing tools and cutting tools arranged to produce creasing lines and slits, respectively, in a pattern adapted for making a packaging design, such as a box. In the prior art, creasing wheels and cutting wheels are separately supported and arranged in tandem in machines through which the web material is advanced by feed rollers. Examples of prior art cutting wheels and creasing wheels may be found in, for example, U.S. Pat. Nos. 5,072,641; 5,964,686, and 6,840,898.

Each operative engagement with a material being fed through separate stations for creasing, cutting etc., increases the risk of the material jamming in or between the separate stations. More stations also means more expensive components such as feed rollers and supporting structures, and results in machines of greater lengths. Longer machines makes the accuracy in lateral guidance of a web material more problematic, and also makes it more difficult to observe and monitor the process and to reach into the structure at maintenance work.

Another problem encountered in connection with forming slits through a corrugated paper board, e.g., is the thickness of the material, resulting from the corrugation that separates the upper paper liner from the lower paper liner. Cutting the corrugated paper board with the circular edge of a cutting wheel thus requires an excessive cutting length through the upper liner and through the corrugation, which may weaken the finished packaging and which may form crack indications that occasionally will lead to rupture. Obviously, this problem grows with increasing radial dimensions of the cutting-wheel.

SUMMARY OF THE INVENTION

The present invention aims to avoid these problems. It is therefore an object of the present invention to provide a cutting- and creasing-wheel assembly, as well as a method, by which safety of operation and precision is enhanced upon cutting through a corrugated or otherwise compressible material.

The object is met through the cutting- and creasing-wheel assembly and by the method, defined in the appending claims.

Briefly, the cutting- and creasing-wheel assembly comprises a cutting tool arranged between a pair of rotatable creasing-wheel halves, the creasing-wheel halves being of equal radial dimension. The cutting tool is controllable between the creasing-wheel halves to engage and to produce a slit in a material which is moved relative to the cutting- and creasing-wheel assembly, or vice versa.

In a preferred embodiment, the cutting- and creasing-wheel assembly comprises a circular disc having a cutting edge. The disc is rotatable and movably supported between a pair of rotatable creasing-wheel, the creasing-wheel halves being of equal radius. The disc is controllable, between the creasing-wheel halves, for movement between a non-operative position wherein said cutting edge is withdrawn inside the outer peripheries of the creasing-wheel halves, and an operative position wherein the cutting edge is projected radially outside said peripheries.

Preferably, the creasing-wheel halves are ring-shaped and journalled for rotation on rollers, the rollers guiding an inner periphery of the ring-shaped creasing-wheel halves.

Also preferred, the radius of the cutting-wheel is less than the radius of the creasing-wheel halves, and an axis of rotation of the cutting-wheel is displaced from a common axis of rotation for the creasing-wheel halves. In this preferred embodiment, the cutting-wheel is guided and controlled for a linear movement in radial direction of the creasing-wheel halves, said movement being substantially perpendicular to the general plane of a material that is processed by the cutting- and creasing-wheel assembly.

Briefly, the method of cutting and creasing a corrugated or otherwise compressible material involves the provision and control of a cutting tool arranged between a pair of rotatable creasing-wheel halves, the creasing-wheel halves being of equal radius. Preferably, the cutting tool is a circular disc having a cutting edge. The disc is arranged to be rotatable and movably supported between the two creasing-wheel halves. Upon cutting, the disc is controlled for projecting said edge radially outside the peripheries of said creasing-wheel halves to engage and to cut a slit through the material, which is moved relative to the cutting- and creasing-wheel assembly, or vice versa.

Preferably, the creasing-wheel halves are driven and controlled for compression of a material while simultaneously controlling the cutting tool to engage and to cut a slit through the compressed material, resulting in a better controlled cut, higher accuracy and less risk of cracking. In the preferred embodiment, the creasing-wheel halves and the cutting tool are arranged and controlled for engagement with the material at points of contact located essentially on a common line, parallel with an axis of rotation of the creasing-wheel halves.

DRAWINGS

The invention is further explained below with reference to the accompanying, diagrammatic drawings, showing one embodiment of the invention and wherein FIG. 1 is a side view showing the cutting- and creasing-wheel assembly in a creasing mode;

DETAILED DESCRIPTION OF ONE EMBODIMENT OF THE INVENTION

Figure 1:
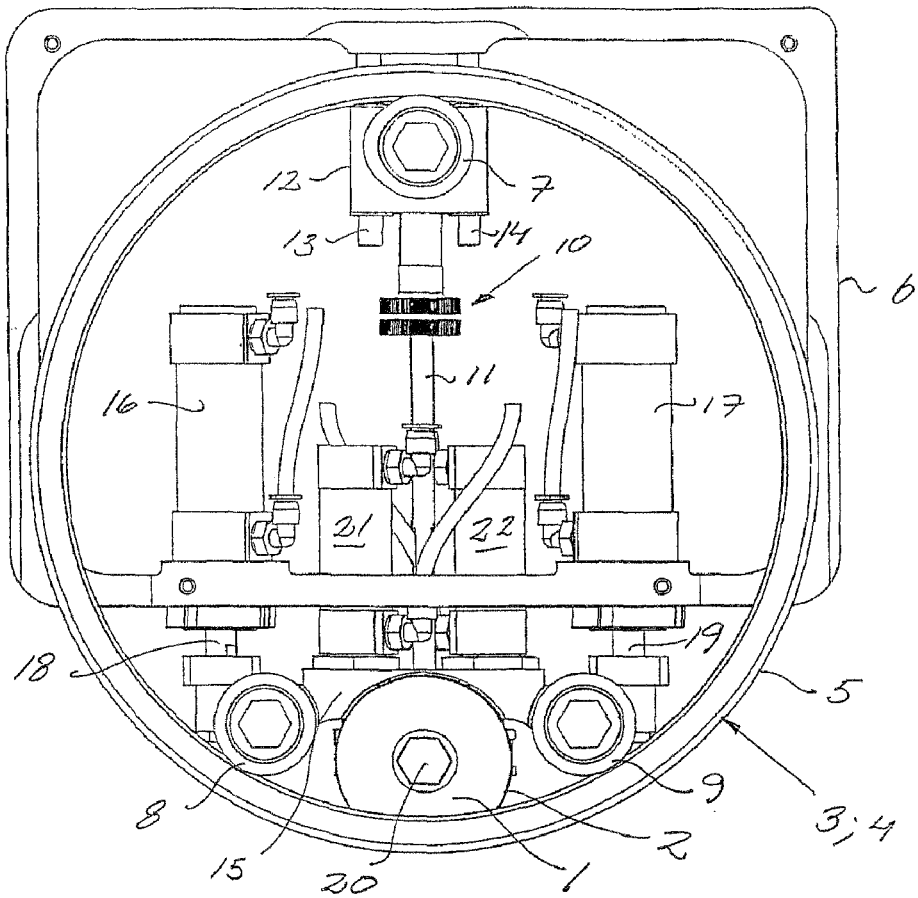
Figure 2:
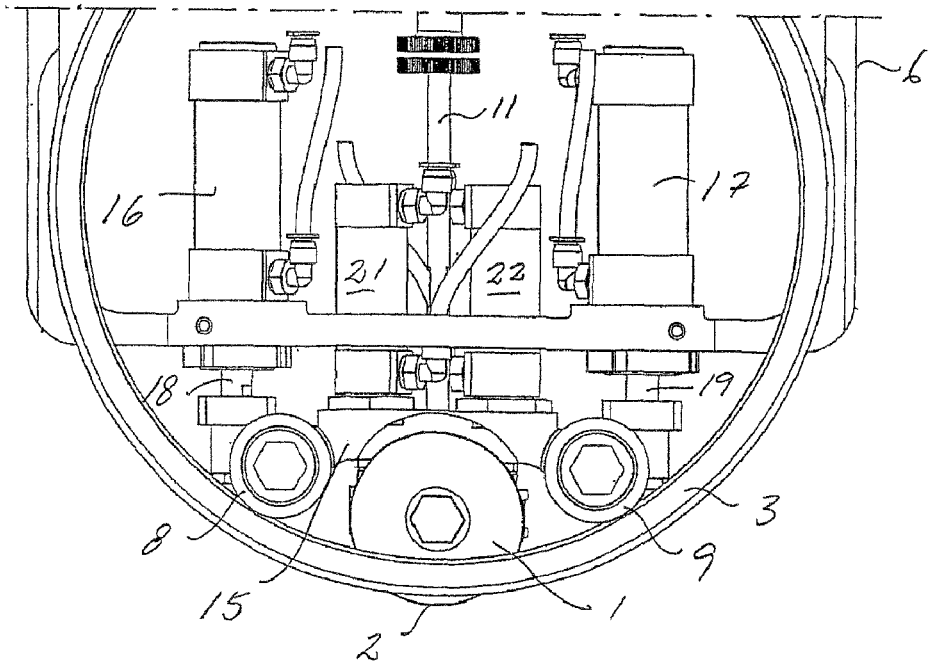
FIG. 2 is a fragmentary side view similar to FIG. 1, showing the cutting- and creasing-wheel assembly in a cutting and creasing mode.
Figure 3:
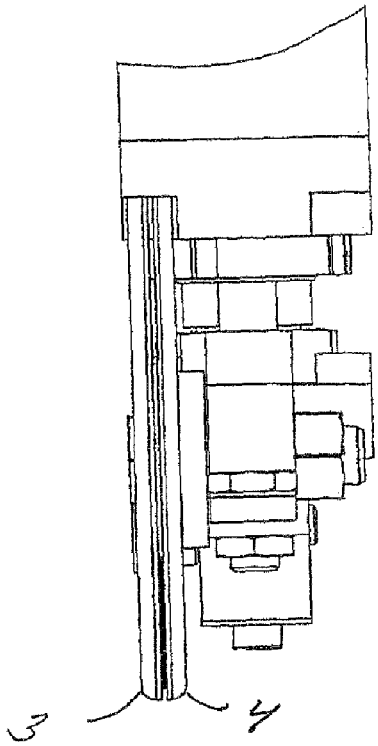
FIG. 3 is a cut away end view showing the cutting- and creasing-wheel assembly in the creasing mode.
Figure 4:
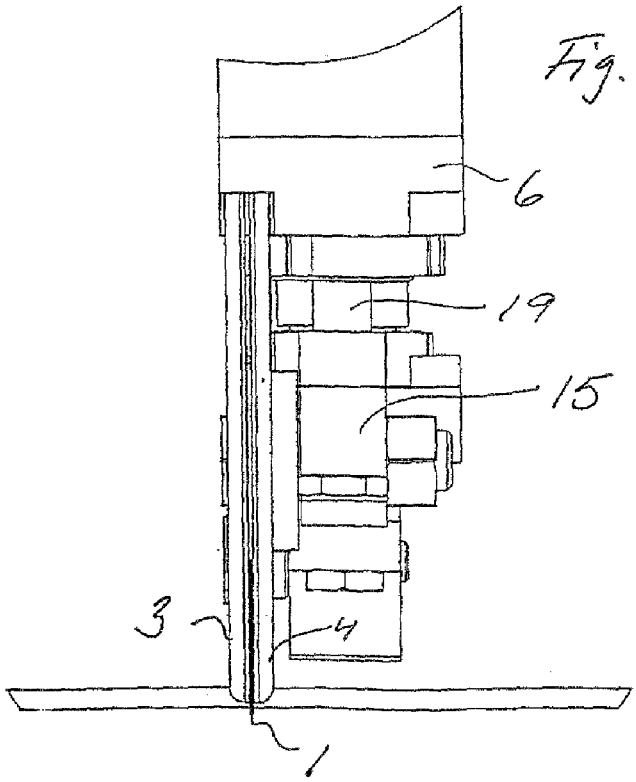
FIG. 4 is an end view similar to FIG. 3, showing the cutting- and creasing-wheel assembly operating on a corrugated web material in a cutting and creasing mode.

With reference to the drawings, a cutting- and creasing-wheel assembly according to a preferred embodiment of the invention comprises a circular disc 1 having a cutting edge 2. The cutting edge may be formed continuously about the entire periphery of the disc, or serrated. The disc 1 is rotatable and movably supported between a pair of rotatable creasing-wheel halves 3 and 4, the creasing-wheel halves being of equal radial dimension. In this context, the expression "creasing-wheel halves" refers to a creasing-wheel structure by which a creasing line is produced by depression of a corrugated or otherwise compressible material in two parallel lines so narrowly spaced that also the material between the lines is compressed, creating in practice a single creasing line allowing for folding the material in a subsequent finishing process. The disc is controllable for movement between a non-operative position (FIGS. 1 and 3) wherein said cutting edge is withdrawn radially inside the outer peripheries 5 of the creasing-wheel halves, and an operative position (FIGS. 2 and 4) wherein the cutting edge 2 is projecting radially outside said peripheries 5.

In a useful application, the cutting- and creasing-wheel assembly is arranged in a machine for producing packaging blanks from a corrugated or otherwise compressible web material. A bracket, the structure of which may be adapted for lateral displacement of the cutting- and creasing-wheel assembly relative to the machine, positions the assembly with respect to a web material that is advanced through the machine in order to be engaged by the cutting- and creasing-wheel assembly, the assembly forming slits and creases in longitudinal and/or transverse directions relative to the feed direction of the material. Optionally, curved or diagonal cutting-and creasing lines may likewise be produced by a proper design and control of the supporting structure. Typically, the cutting- and creasing-wheel assembly is associated with counter-pressure rollers (not shown in the drawings) supporting the web material from the opposite side and assisting cutting- and creasing-wheel assemblies operating in the feed direction, or by a transverse supporting element (also not shown in the drawings) running transversally to the feed direction and assisting a cutting- and creasing-wheel assembly operating in the transverse direction. Attached to the bracket, or formed integrally therewith, is a carrier 6. As will be explained further below, the carrier 6 houses bearings and drive means for controlling rotation and movements of the creasing-wheel halves 3,4 and the cutting tool or disc 1.

The creasing-wheel in the cutting- and creasing-wheel assembly of the present invention comprises two rings 3 and 4, each of which is formed with an outer and an inner periphery. The rings 3 and 4 are of equal outer radial dimension and, typically, also of equal inner radial dimension. The inner peripheries of the rings 3,4 are guided on rollers 7, 8 and 9, arranged for the rings to be freely rotating with their centers located on a common axis of rotation. The inner peripheries of the two rings are chamfered and received, respectively, in corresponding notches formed circumferentially on the rollers. The outer peripheries of the rings 3,4 are rounded towards the sides facing outward of the creasing-wheel, while the sides facing the opposite ring may connect more sharply to the periphery. The rings are journalled on the rollers with an axial spacing, providing there between a gap sufficient for the disc 1 to move between the rings into an operative position as will be further described below.

The rollers 7, 8 and 9 are journalled for rotation on bearings arranged on a lifter 10, which is guided in the carrier 6 for linear movements substantially perpendicular to the web material, i.e. in a vertical direction when the web material is advanced horizontally beneath the cutting- and creasing-wheel assembly as is typically the case. The lifter 10 comprises a vertical rod 11 reaching through the carrier 6 and guided therein through an opening formed in a lower member of the carrier. In its top end, the rod 11 carries a slide block 12 that journals a roller 7 for the creasing-wheel halves 3,4. The slide block 12 is guided on pillars 13, 14 depending from an upper member of the carrier 6, supporting a jam free motion of the lifter. In its lower end, the rod 11 carries a horizontal girder 15 that journals a pair of rollers 8 and 9 for the creasing-wheel halves 3,4.

The operative positions of the cutting- and creasing-wheel assembly are controlled by the operation of a power unit acting between the carrier 6 and the girder 15. In the shown embodiment, two cylinders 16 and 17 powered by air are attached to the carrier while the cylinder pistons 18, 19 are connected to the ends, respectively, of the girder 15. Extension of the pistons will thus extend the lifter 11, girder 15, rollers 7, 8 and 9, and the rings or creasing-wheel halves 3 and 4. Naturally, hydraulic liquid or electricity may be used to operate the power unit/units.

The cutting tool, i.e. the disc 1 described above, is carried by the girder 15, or more precisely, journalled for free rotation on a pivot bearing 20 connected to the piston ends of two cylinder units 21 and 22 that are carried by the girder. By operation of the cylinders 21 and 22, in this embodiment driven by air, the disc 1 is controlled to move relative to and between the creasing-wheel halves, from a non-operative position shown in FIG. 3 wherein the cutting edge 2 is withdrawn inside the outer peripheries 5 of the creasing-wheel halves 3 and 4, to an operative position shown in FIG. 4 wherein the cutting edge projects radially outside said peripheries to engage and to form a slit through the material.

In practice, preferably, the cutting tool or disc 1 is projected by operation of the cylinders 21,22 to form a slit through the compressible material, while simultaneously the creasing-wheel halves 3,4 are activated for compression of the material, thus reducing the thickness and avoiding the need for excessive cutting length through, e.g., the upper liner and corrugation of a corrugated material. By arranging the cutting-wheel to cut the material through a gap formed between the halves of a split creasing-wheel, the points of contact between the material and the creasing-wheel halves and cutting-wheel, respectively, are located substantially on a common line, parallel with an axis of rotation of the cutting- and creasing-wheel assembly. Since cutting is performed on a reduced material thickness, cutting discs of reduced diameter size may be used. The smaller diameter also allows for reduced thickness of the disc, allowing a minimum gap between the creasing-wheel halves. In other words, since compression and cutting is performed simultaneously in more or less one single point, using a cutting disc of small dimensions, the precision by which slits may be formed through a corrugated or otherwise compressible material in a machine for producing packaging blanks will be substantially enhanced through the present invention.

Arranging the cutting tool simultaneously to operate at substantially the same point as the creasing tool makes a packaging design program more easy to produce, and may also increase the capacity of the machine. The reason for the later is, that a cut normally should be performed after the creasing operation in order to avoid cracks. To secure this, an inactive backward movement of the tool may be required or multiple tools be installed in succession. Such inactive movement and multiple installations will be avoided through the present invention.

Furthermore, projecting the cutting tool all way through a corrugated material will take longer time as compared to a corrugated material in a compressed condition, where the tool only has to project a couple of millimeters. This difference in length of movement makes it possible to increase the capacity of the machine while still maintaining the accuracy of cutting, especially when the tools are operated while the material is moved relative to the assembly or vice versa. This is particularly important when cutting short slits or perforations through a corrugated material, e.g.

The preferred embodiment also is a weight-effective solution that allows the use of creasing-wheels having greater radius: in order to achieve more easily folded creasing lines, higher pressing force may be applied from the bigger creasing-wheels without cracking the paper liner of a corrugated paper board.

In the shown embodiment the cutting tool is a circular disc, which may be preferred in connection with corrugated paper boards. However, other types of cutting tools may be arranged between the creasing-wheel halves and controlled for a single-point engagement in cooperation with the split creasing-wheel. Alternative tools, such as laser cutters, water jet cutters, abrasive water jets and non-circular knifes, e.g., may thus be used in combination with the split creasing-wheel to achieve the higher precision cuts through a compressed section of a compressible material.

Although the invention is explained with reference to a machine for producing packaging blanks from a web material that is advanced through the machine, the suggested compact structure of a cutting- and creasing-wheel assembly is equally useful in applications where a stationary material is processed by one or more cutting-and creasing-wheel assemblies, driven for movement relative to the material.

The invention claimed is:

1. A cutting- and creasing-wheel assembly comprising:

a pair of creasing-wheels of equal radial dimensions, arranged axially separated and rotating with their centers located on a common axis of rotation, and narrowly spaced to create a singular creasing line in a compressible web material;

a circular cutting-wheel journalled for rotation between the creasing-wheels at an axis of rotation which is separate and arranged displaceable from said axis of rotation through the centers of the creasing-wheels;

the cutting-wheel having a cutting edge on its periphery at a radius which is less than the radius of the creasing-wheels, wherein the cutting-wheel is controllable, through displacement of its axis of rotation, to move between the creasing-wheels from a non-operative position radially inside the outer peripheries of the creasing-wheels to an operative position wherein the cutting edge projects radially outside said outer peripheries, whereby the cutting- and creasing-wheel assembly is controllable simultaneously to perform cutting and creasing at substantially the same point of contact with the web material.

2. The cutting- and creasing-wheel assembly of claim 1, wherein the creasing wheels are ring-shaped and of equal outer and inner radial dimensions, the inner peripheries of the creasing-wheels journalled on rollers on which the creasing-wheels are arranged axially separated and freely rotating with their centers located on a common axis of rotation.

3. The cutting- and creasing-wheel assembly of claim 2, wherein the cutting-wheel is journalled on a pivot for free rotation between the creasing-wheels.

4. The cutting- and creasing-wheel assembly of claim 3, wherein the cutting-wheel is journalled on a pivot connected with an air-actuated piston/cylinder unit controlling the cutting-wheel in a movement in a substantially radial direction of the creasing-wheels.

5. The cutting- and creasing-wheel assembly of claim 4, wherein the creasing-wheels and the cutting-wheel are supported in a lifter assembly which is guided for movements substantially perpendicular to a web material to be processed by the cutting- and creasing-wheel assembly, and which is operated by a power unit that controls the operative positions of the cutting- and creasing-wheel assembly.

6. The cutting- and creasing-wheel assembly of claim 5, wherein the lifter assembly comprises a rod that is guided in the carrier to move in vertical directions, the rod in a top end supporting a first roller and in a lower end supporting second and third rollers on which the creasing-wheels are journalled for free rotation.

7. The cutting- and creasing-wheel assembly of claim 6, wherein the lifter assembly comprises a rod which in its lower end supports the piston/cylinder units connected to the pivot on which the cutting-wheel is journalled for free rotation.

8. The cutting- and creasing-wheel assembly of claim 7, wherein the lifter assembly comprises a rod which in its lower end carries a horizontal girder member carrying the piston/cylinder units which are connected to the cutting-wheel pivot, the girder connected to two air actuated piston/cylinder units acting between the girder and the carrier.

9. The cutting- and creasing-wheel assembly of claim 1, wherein the outer peripheries of the creasing-wheels are rounded towards the sides facing outward from the cutting-wheel, whereas the sides facing inward connect more sharply to the peripheries.

10. The cutting- and creasing-wheel assembly of claim 1, wherein the cutting edge runs continuously about the periphery of the cutting-wheel.

11. The cutting- and creasing-wheel assembly of claim 1, wherein the cutting edge runs serrated about the periphery of the cutting-wheel.

12. The cutting- and creasing-wheel assembly of claim 1, wherein the cutting-wheel is journalled on a pivot for free rotation between the creasing-wheels.

13. A method of forming slits and creases in a compressible web material, comprising the steps of providing a pair of creasing-wheels of equal radial dimensions, and arranging the creasing-wheels axially separated and rotatable with their centers located on a common axis of rotation, and narrowly spaced to create a singular creasing line in a compressible web material;

providing a circular cutting-wheel with a circular continuous or serrated cutting edge on its periphery at a radius which is less than the radius of the creasing-wheels;

arranging the cutting-wheel rotatable between the creasing-wheels at an axis of rotation which is separate and arranged displaceable from said axis of rotation through the centers of the creasing-wheels, and controlling the cutting-wheel, through displacement of its axis of rotation, to project the cutting edge radially outside the outer peripheries of the creasing-wheels in simultaneous cutting and creasing operations, and to retract the cutting edge inside the outer peripheries of the creasing-wheels in creasing operations, whereby the cutting- and creasing-wheel assembly is controllable simultaneously to perform cutting and creasing at substantially the same point of contact with the web material.

14. The method of claim 13, comprising the step of arranging the cutting-wheel movable in a substantially radial direction of the creasing-wheels, and controlling the cutting-wheel in movements substantially perpendicular to the compressible web material.

* * * * *